US006053099A

United States Patent [19]

Gruber

[11] Patent Number: 6,053,099

[45] Date of Patent: Apr. 25, 2000

[54] FLYWHEEL ENGAGED PUMP/MOTOR

[75] Inventor: Steven M. Gruber, Minster, Ohio

[73] Assignee: The Minster Machine Company, Minster, Ohio

[21] Appl. No.: 09/140,803

[22] Filed: Aug. 26, 1998

[51] Int. Cl.[7] ..... B30B 15/28

[52] U.S. Cl. ..... 100/35; 72/1; 72/21.3; 74/125; 74/405; 100/282; 100/341; 192/144

[58] Field of Search ..... 100/35, 53, 270, 100/280, 282, 353, 341; 72/1, 21.3, 444; 74/125, 716, 405, 406; 192/144, 148

[56] References Cited

U.S. PATENT DOCUMENTS

| | | | |
|---|---|---|---|
| 1,869,084 | 7/1932 | Williamson | 192/144 |
| 2,185,551 | 1/1940 | Glasner et al. | 192/144 |
| 2,366,272 | 1/1945 | Le Tourneau | 100/282 |
| 2,378,062 | 6/1945 | Byerlein | 100/282 |
| 2,559,195 | 7/1951 | May | 72/444 |
| 2,854,115 | 9/1958 | Friedman | 192/144 |
| 3,470,989 | 10/1969 | Jeavons | 100/53 |
| 3,859,863 | 1/1975 | Howlett | 74/125 |
| 3,888,097 | 6/1975 | Fortman et al. | 72/21.3 |
| 3,960,028 | 6/1976 | Martin | 74/405 |
| 4,325,678 | 4/1982 | Kanamaru et al. . | |
| 4,563,889 | 1/1986 | Landwehr . | |
| 4,825,659 | 5/1989 | Huydts . | |
| 5,048,410 | 9/1991 | Teramoto et al. | 100/53 |
| 5,158,723 | 10/1992 | Walchhutter et al. . | |
| 5,325,668 | 7/1994 | Walchhutter et al. . | |
| 5,526,738 | 6/1996 | Logan . | |
| 5,603,237 | 2/1997 | Bohman et al. . | |
| 5,647,208 | 7/1997 | Spitzbarth . | |

FOREIGN PATENT DOCUMENTS

| | | | |
|---|---|---|---|
| 4042185 | 7/1991 | Germany | 100/280 |
| 1632790 | 3/1991 | U.S.S.R. | 100/280 |
| 2240943 | 8/1991 | United Kingdom | 100/280 |
| 2258186 | 2/1993 | United Kingdom | 100/282 |

*Primary Examiner*—Stephen F. Gerrity
*Attorney, Agent, or Firm*—Randall J. Knuth

[57] ABSTRACT

A system for use in a press machine includes a drive assembly in the form of a pinion gear that selectively engages the flywheel to enable operative driving rotation of the pinion gear by the flywheel. A load system in the form of a hydraulic pump is arranged in operative driving relationship with the pinion gear. Accordingly, rotational energy withdrawn from the flywheel becomes available for use in driving the hydraulic pump, which is preferably arranged in fluid communication with the press machine to supply a flow of oil for lubrication purposes. An adjustment assembly is arranged to controllably reversibly displace the pinion gear to effect its selective engagement with the flywheel. The pinion gear is provided with a geared peripheral surface for intermeshing engagement with the flywheel at a geared periphery thereof. The system may also be operated in reverse to drive the flywheel.

38 Claims, 3 Drawing Sheets

FLYWHEEL ENGAGED PUMP/MOTOR

BACKGROUND OF THE INVENTION

1. Field of the Invention

The present invention relates generally to mechanical press machines, and, more particularly, to a system including an assembly, such as a gear assembly, arranged to be driven by the press flywheel and connected in one form to a hydraulic pump that supplies a fluid flow to the press machine under the influence of the flywheel.

2. Description of the Related Art

Mechanical presses of the type performing stamping and drawing operations employ a conventional construction that includes a frame structure having a crown and bed portion and which supports a slide in a manner enabling reciprocating movement toward and away from the bed. A press drive assembly including a crankshaft having an arm assembly connected to the slide is arranged to convert rotary-oscillatory motion into the linear reciprocating motion of the slide. These press machines are widely used for a variety of workpiece operations employing a large selection of die sets, with the press machine varying considerably in size and available tonnage depending upon its intended use.

The loads developed during press operation put significant stresses on various machine parts such as the crankshaft which nevertheless must provide stable bearing support throughout the entire processing cycle. The integrity of this bearing support takes on added importance during high acceleration duty cycles designed to deliver substantial impact forces to the workpiece. It therefore becomes imperative that the press machine be provided with some form of lubrication system to supply the machine parts with a fluid flow sufficient to create a hydrostatic and hydrodynamic bearing support, for example. The fluid flow also serves to draw heat away from the machine parts so that the press equipment remains within its normal operating temperature range.

Conventional lubrication systems employ a hydraulic pump driven by a motor that is typically connected to the same power source used by the press motor. Although efficient in terms of minimizing the electrical requirements, this form of power sharing produces deleterious results when an electrical failure cuts off the energy supply to the machine, leaving not only the press machine inoperable but also the lubrication system. An unplanned interruption in the machining operation, however, may not produce irreparable harm to the workpiece since the power failure simply causes a suspension in the processing activity that can be successfully resumed once power is restored. However, the demands of the press machine associated with parts lubrication and heat dissipation must continue to be met in order to protect the machine from potential damage caused by overheating and structural degradation arising from the immediate loss of lubricating fluid. Replenishing the hydraulic fluid flow in a timely manner represents a priority for the machine operator during power failure. This may be accomplished by reactivating the lubrication system using a backup power source or immediately diagnosing and fixing the problem in the main power supply. Both techniques, however, are time consuming and require the integration of an auxiliary power device or, alternatively, the construction of an automatic power diagnostic unit that must provide a real-time solution to the problem.

SUMMARY OF THE INVENTION

The present invention generally provides a drive assembly in the form of a pinion gear or wheel that selectively engages a rotary member of the press machine such as the flywheel to enable operative driving rotation of the pinion gear or wheel by the flywheel. A load system in the form of a mechanical assembly including a hydraulic pump is arranged in operative driving relationship with the pinion gear or wheel of the drive assembly. Accordingly, rotational energy withdrawn from the flywheel by the drive assembly becomes available for use in driving the hydraulic pump, which is preferably arranged in fluid communication with the press machine. An adjustment assembly is arranged to controllably reversibly displace the pinion gear or wheel of the drive assembly to effect its selective engagement with the flywheel. The pinion gear is preferably provided with a geared peripheral surface for intermeshing engagement with the flywheel at a geared periphery thereof. This system, according to a preferred utilization thereof, takes advantage of the fact that the flywheel continues to rotate for some time during a power failure by virtue of its inertial properties, allowing the engaged pinion gear to be rotatably driven by the flywheel and, in turn, to operatively drive the hydraulic pump so that a flow of hydraulic fluid is supplied to the press machine despite the power loss. The engagement of the pinion gear with the flywheel may occur at other moments of machine operation within the scope of the present invention. Alternatively, a wheel driven by frictional contact with the flywheel may be utilized instead of the pinion gear.

The invention, in one form thereof, comprises a system for use in a press machine, such press machine including a frame structure with a crown and a bed, a slide operatively guided by the frame structure for reciprocating movement in opposed relation to the bed, and a press drive means attached to the frame structure for operatively reciprocating the slide, the press drive means including a rotary member. The system comprises an engagement means for selectively engaging the rotary member of the press drive means to withdraw rotational energy therefrom; and a maneuvering means, operatively coupled to the engagement means, for controllably reversibly displacing the engagement means to effect the selective engagement of the engagement means with the rotary member of the press drive means.

There is further included a load means, which is operatively arranged in energy communicating relationship with the engagement means, for having delivered thereto rotational energy withdrawn from the rotary member of the press drive means by the engagement means. The load means, in one form thereof, includes a hydraulic pump arranged in driving relationship with the engagement means and further arranged to provide a hydraulic fluid flow to the press machine.

The engagement means, in one form thereof, further comprises a rotary device including a geared surface and adjustably disposed for engagement at the geared surface thereof with the rotary member of the press drive means. The rotary member of the press drive means preferably includes a flywheel having a geared surface, and the rotary device of the engagement means preferably includes a pinion gear for engagement with the flywheel at the geared surface thereof. The pinion gear is arranged to drive the hydraulic pump.

The maneuvering means, in one form thereof, further includes a slider mount assembly slidably securing the engagement means to the press machine; a driving mechanism, which is operatively connected to the slider mount assembly, to effect a controllable reversible displacement of the engagement means; and a control means for controlling the operation of the driving mechanism.

The invention, in another form thereof, comprises a system for use in a press machine, such press machine including a frame structure with a crown and a bed, a slide operatively guided by the frame structure for reciprocating movement in opposed relation to the bed, and a press drive means attached to the frame structure for operatively reciprocating the slide, the press drive means including a rotary member. The system comprises a drive assembly arranged for operative engagement with the rotary member of the press drive means to enable the rotary member to exert a driving influence on the drive assembly; and a load system, including a mechanical assembly, arranged to be driven, at least in part, by the drive assembly. There is further provided an adjustment assembly arranged to controllably reversibly dispose the drive assembly into a selectable one of engagement with the rotary member and disengagement from the rotary member.

The adjustment assembly, in one form thereof, includes a slider mount assembly slidably securing the drive assembly to the press machine; a driving mechanism, which is operatively connected to the slider mount assembly, to effect a controllable reversible displacement of the drive assembly; and a control means for controlling the operation of the driving mechanism. The driving mechanism further includes a hydraulic piston-cylinder device.

The drive assembly, in one form thereof, further includes a gear including a geared surface and arranged for operative driving rotation by the rotary member by selective engagement at the geared surface thereof with the rotary member. The mechanical assembly, in one form thereof, further includes a hydraulic pump arranged in driving relationship with the gear of the drive assembly. The adjustment assembly is arranged to controllably reversibly displace the gear of the drive assembly into selective engagement with the rotary member.

The invention, in another form thereof, comprises a system for use in a press machine, such press machine including a press rotary member rotatably mounted therein. The system comprises a rotary device selectively engaging the press rotary member to enable operative driving rotation of the rotary device by the press rotary member; a first assembly, including a movable element, arranged in operative driving relationship with the rotary device; and a displacing assembly arranged to controllably reversibly dispose the rotary device to cause the selective engagement of the rotary device with the press rotary member.

The press rotary member further includes a flywheel having a geared periphery, and the rotary device further includes a gear having a geared surface for intermeshing engagement with the geared periphery of the flywheel. The first assembly, in one form thereof, further includes a pump including a rotary element and arranged in operative driving relationship with the gear of the rotary device. The displacing assembly, in one form thereof, further includes a slider mount assembly slidably securing the rotary device to the press machine; a driving mechanism, operatively connected to the slider mount assembly, to effect a controllable reversible displacement of the rotary device; and a control means for controlling the operation of the driving mechanism.

The invention, in another form thereof, includes a system for use in a press machine, such press machine including a flywheel rotatably mounted therein. The system comprises a rotary device operatively engaging the flywheel to enable operative driving rotation of the rotary device by the flywheel, such rotary device including a geared peripheral surface for operative intermeshing engagement with the flywheel at a geared peripheral surface thereof; and a first assembly, including a pump, arranged in operative driving relationship with the rotary device. There is further provided a displacing assembly arranged to controllably reversibly displace the rotary device into a selectable one of engagement with the flywheel and disengagement from the flywheel.

The pump of the first assembly is arranged to provide a hydraulic fluid flow for use in the press machine. The rotary device, in one form thereof,is permanently engaged to the flywheel.

The invention, in yet another form thereof, comprises a mechanical press including, in combination, a frame structure with a crown and a bed; a slide operatively guided by the frame structure for reciprocating movement in opposed relation to the bed; a press drive means attached to the frame structure for operatively reciprocating the slide, the press drive means comprising a flywheel having a geared peripheral surface; a drive assembly selectively engaging the flywheel to enable operative driving rotation of the drive assembly by the flywheel, the drive assembly including at least one gear having a geared peripheral surface for selective engagement with the flywheel; a first assembly arranged in operative driving relationship with the drive assembly, the first assembly including at least one pump each arranged in operative driving relationship with a respective one of the at least one gear of the drive assembly; and a displacing assembly arranged to controllably reversibly dispose each one of the at least one gear of the drive assembly to cause the selective engagement of the drive assembly with the flywheel. The displacing assembly comprises a slider mount assembly slidably securing the drive assembly to the mechanical press; a driving mechanism, operatively connected to the slider mount assembly, to effect a controllable reversible displacement of the drive assembly; and a control means for controlling the operation of the driving mechanism.

The invention, in yet another form thereof, comprises a method of extracting rotational energy from a press rotary member rotatably mounted in a press machine. The method includes the steps of engaging the press rotary member at the outer periphery thereof with a rotary device to enable operative driving rotation of the rotary device by the press rotary member; and providing a load assembly arranged in operative driving relationship with the rotary device. The load assembly, in one form thereof, further includes a hydraulic pump. The engaging step, in one form thereof, further comprises the step of controllably reversibly displacing the rotary device to effect a selective engagement of the rotary device with the press rotary member. In a preferred form, the press rotary member includes a flywheel having a geared periphery, and the rotary device includes a gear having a geared periphery for intermeshing engagement with the flywheel at the geared periphery thereof.

The invention, in still yet another form thereof, comprises a method of supplying a press machine with a hydraulic fluid flow, such press machine including a press rotary member rotatably mounted therein. The method comprises the steps of engaging the press rotary member at the outer periphery thereof with a rotary device to enable operative driving rotation of the rotary device by the press rotary member; and providing a hydraulic pump arranged in operative driving relationship with the rotary device and further arranged in operative fluid flow communication with the press machine. The engaging step, in one form thereof, further includes the step of controllably reversibly displacing the rotary device to effect a selective engagement of the rotary device with the press rotary member. In a preferred form, the press rotary member includes a flywheel having a geared periphery, and the rotary device includes a gear having a geared periphery for intermeshing engagement with the flywheel at the geared periphery thereof.

One advantage of the present invention is that the system arranged to be driven by the press machine flywheel enables hydraulic fluid to be supplied to the press machine during power failure events because the hydraulic pump, which is integrally connected to the flywheel-driven gear, continues to function under the driving influence of the inertial flywheel.

Another advantage of the present invention is that the drive system eliminates the need to provide an auxiliary power source to operate the press hydraulic pump since the pump is powered by the rotational energy withdrawn from the flywheel and communicated thereto.

Another advantage of the present invention is that the drive system can be adapted to function as a braking mechanism by suitably arranging the pinion gear and pump combination (or other load device) to effect a controllable reduction in the operating speed of the flywheel, even to the point of bringing the flywheel (and reciprocating slide) to a complete stop.

Another advantage of the present invention is that the drive system facilitates a selective engagement of the pinion gear with the flywheel by using an adjustment assembly that controllably reversibly displaces the gear into a selectable one of engagement with the flywheel and disengagement from the flywheel, permitting the operator to control the times at which rotational energy is to be withdrawn from the flywheel and subsequently applied towards the development of productive work, e.g., driving a hydraulic pump or motor.

Yet another advantage of the present invention is that the invention may be utilized to drive the flywheel (motorized barring). This requires that the pump utilized in the invention can also operate as a motor.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 4:
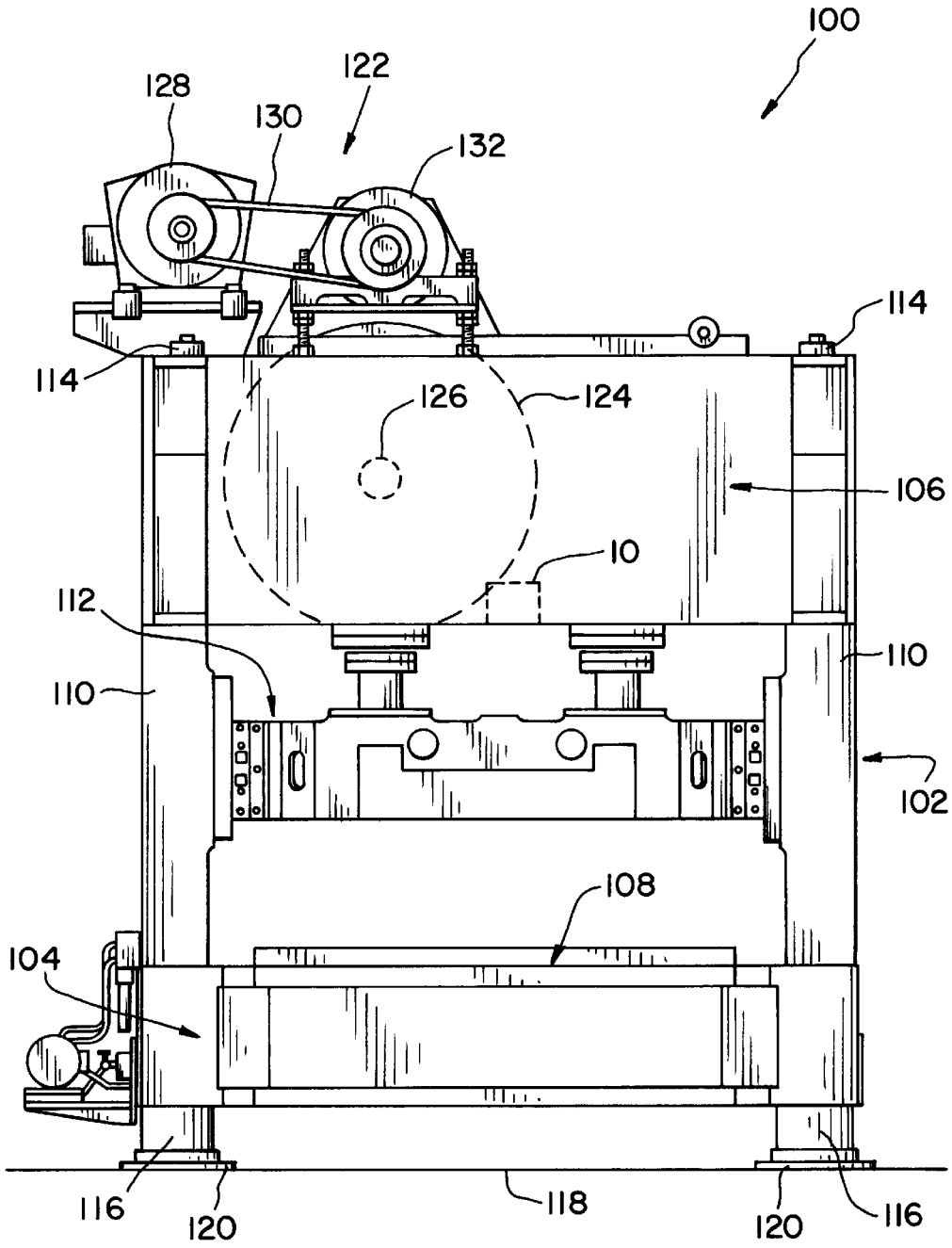
FIG. 4 is a front elevational view of an illustrative mechanical press incorporating the drive system of the present invention.

For background purposes, reference is first made to FIG. 4 in which there is shown an illustrative mechanical press 100 that incorporates a drive system according to one form of the present invention (generally illustrated at 10). Press machine 100 is made according to conventional construction and includes frame structure 102 having a bed portion 104 and a crown portion 106. Bed portion 104 includes a bolster assembly 108 connected thereto for securably supporting a lower die member (not shown). Uprights 110 are connected to or integral with the underside of crown 106 and bed 104 to provide an attachment structure formed therebetween. A slide 112 is positioned between uprights 110 in opposed relation to bed 104 and undergoes controlled reciprocating movement between crown 106 and bed 104. An upper die member (not shown) is attached in a conventional manner to the lower end of slide 112. Tie rods (not shown) extending through crown 106, uprights 110 and bed 104 are attached at each end with tie rod nuts 114. Leg members 116 formed as an extension of bed 104 are generally mounted on shop floor 118 by means of shock absorbing pads 120.

A press drive assembly 122 contained within or supported by crown 106 activates and controls the movement of slide 112. The illustrated drive assembly 122 includes a flywheel 124, crankshaft 126, and clutch assembly (not shown) arranged in a conventional manner. The drive mechanism, for example, includes a press drive motor 128 attached by means of a belt 130 to an auxiliary flywheel 132 attached to crown 106. Auxiliary flywheel 132 is connected in turn by conventional means to the main flywheel 124 of the combination clutch/brake assembly. Crown 106 also includes conventional devices such as connecting rods (not shown) to assist in the conversion of the rotary-oscillatory motion of the rotating members (i.e., crankshaft 126) into the linear reciprocating motion of slide 112, as is known in the art. When press drive motor 128 is energized, the relatively massive main flywheel 124 is caused to continuously rotate. Accordingly, when the clutch is activated, the rotary motion of flywheel 124 is transmitted to crankshaft 126, which causes the connecting rods to undergo rotary-oscillatory motion that is communicated to slide 112 as straight reciprocating motion using a wrist pin, for example. The connecting rods are coupled directly to slide 112 or connected in a conventional manner by means of pistons that in turn are slidably received within cylinders attached to crown 106.

This particular form of mechanical press 100 is described for illustrative purposes only as it should be apparent to those skilled in the art that the principles of the present invention may be practiced with and incorporated into other machine configurations within the scope of the present invention. Accordingly, the present invention as shown and described herein will illustratively refer to mechanical press 100 of FIG. 4, although it should be understood that the drive system of the present invention may be incorporated into other types of press machine configurations in a similar manner to achieve a similar functionality. Additionally, it should be understood that the present invention may be integrated within application environments encompassing machine arrangements other than mechanical presses. For example, the present invention could be utilized within any form or type of industrial equipment including a rotary member or other similar device for which the drive system of the present invention may be adapted to extract and/or withdraw energy therefrom, which is then preferably used in the service of producing useful work, e.g., powering a motor or hydraulic pump.

Figure 1:
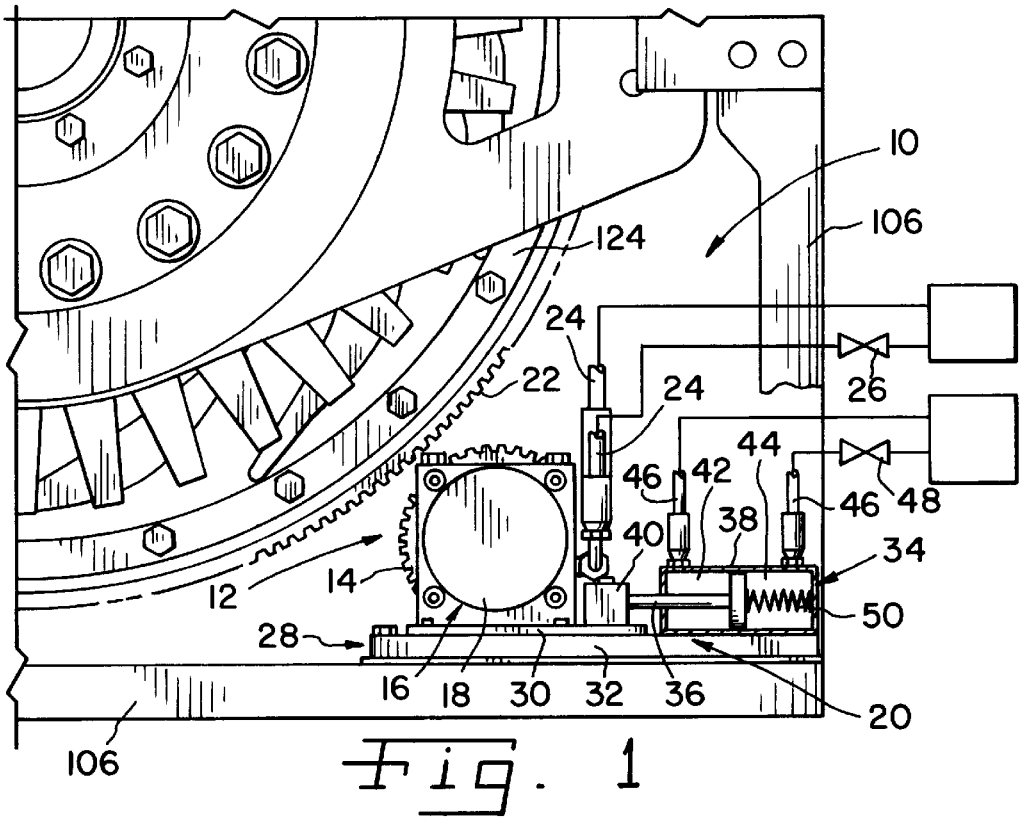
FIG. 1 is an elevational schematic view of the present invention in one illustrative form thereof depicting the drive system as disengaged from the flywheel.

Turning now to a detailed description of the present invention, reference is made to FIG. 1 in which there is shown a schematic view of drive system 10 according to one illustrative form of the present invention as arranged in a condition of disengagement relative to flywheel 124. The illustrated drive system 10 includes a drive assembly 12 preferably provided in the form of a pinion gear 14 adjustably disposed for operative engagement with flywheel 124; a load assembly 16 preferably provided in the form of a hydraulic pump 18 arranged in operative driving relationship with pinion gear 14; and an adjustment assembly 20 arranged to controllably reversibly dispose drive assembly 12 to effect the operative engagement of pinion gear 14 with flywheel 124. This operative engagement between drive assembly 12 and flywheel 124 enables flywheel 124 to exert a driving influence on drive assembly 12 (i.e., pinion gear 14) that in turn acts to drive the integrally connected hydraulic pump 18, which in one preferred form is arranged to provide a hydraulic fluid flow to the operatively associated press machine 100. Pinion gear 14, in particular, is provided as shown with a geared peripheral surface for intermeshing engagement with gear teeth 22 disposed circumferentially about flywheel 124, thereby enabling pinion gear 14 to be rotatably driven by flywheel 124.

Drive assembly 12 includes, as shown, the illustrated pinion gear 14 spatially separated from flywheel 124 in a manner corresponding to a disengaged condition for drive system 10. It is preferable that the driving rotation of gear 14 by flywheel 124 (as illustrated by the engaged condition shown in FIG. 2) develop a high torquing action allowing a high level of power transfer to gear 14 with only incrementally small rotary displacements of flywheel 124. This feature is accomplished in one form by establishing a relatively large difference between the respective circumferences of gear 14 and flywheel 124. For example, flywheel 124 may have a circumference of 40 inches with 249 teeth disposed thereabout while gear 14 may have a circumference of 6 inches with 36 teeth on its periphery. Gear 14 is broadly representative of any type of rotary device (e.g., toothed wheel and friction driven wheel) that can be fashioned for intermeshing engagement (or other type of engagement) with flywheel 124. Additionally, drive assembly 12 may include a plurality of gears or other form of drive train members suitable for engaging flywheel 124 at multiple circumferential points thereof and withdrawing energy therefrom in a serial or parallel manner. For example, a plurality of discrete pinion gears 14 may be disposed about the periphery of flywheel 124 for individual driving rotation by flywheel 124 through respective selective engagement therewith. Additionally, gear 14 may be coupled to a drive train that enables the rotational energy derived from flywheel 124 to be communicated to remote devices in a similar form or in alternative forms, e.g., linear motion.

Load assembly 16 includes as shown the illustrated hydraulic pump 18 arranged in operative driving rotation with gear 14. Load assembly 16 is generally representative of any device or system that gear 14 delivers power to as gear 14 is being rotatably driven by flywheel 124. Pump 18, for example, may be of conventional design having a rotatable element that is integrally coupled to gear 14 in a conventional manner such that operative rotation of gear 14 under the driving influence of flywheel 124 causes pump 18 to become operational. For this purpose, pump 18 would be arranged in driving relationship with gear 14 in a manner that enables operative driving of pump 18 by gear 14. This driving connection with gear 14, in one form of the invention, obviates the need for any motorized driving of pump 18 since the rotatably driven gear 14 supplies the necessary motive power for driving pump 18. Pump 18, in one form thereof, is provided with hydraulic fluid lines 24 of conventional design to permit hydraulic fluid to flow into and out of hydraulic pump 18. One of the fluid lines 24, for example, is preferably connected to a hydraulic fluid source such as an oil reservoir. Additionally, a fluid control means 26 is preferably disposed in or connected to one of the fluid lines 24 in a conventional manner to control the flow of hydraulic fluid generated by pump 18. Such fluid control means 26 may be implemented by manual or computer controlled valves, solenoids, manifolds, or other forms of fluid regulators that are able to control hydraulic fluid flow. The regulated fluid flow provided by fluid control means 26 is preferably supplied to the press machine in the form of a lubricating fluid stream. For this purpose, fluid control means 26 is preferably coupled to a suitable piping arrangement for distributing and transporting the fluid to the press machine, such as to bearing areas of the crankshaft, flywheel, and other rotary components.

Adjustment assembly 20 performs a controllable reversible displacement of drive assembly 12 causing it to move or slide rectilinearly toward or away from flywheel 124 to respectively engage or disengage. The illustrated adjustment assembly 20 includes, in part, a slider mount assembly 28 comprising a sliding platform 30 and a slider mount 32. Slider mount 32 is fixedly secured to the press machine at crown 106, for example, and forms a structure for guidedly supporting movable sliding platform 30 to which at least drive assembly 12 (i.e., pinion gear 14) is mounted. In a preferred form, pinion gear 14 and hydraulic pump 18 are integrally mounted on sliding platform 30. By this arrangement, gear 14 and pump 18 are slidably secured to the press machine. However, this configuration is merely illustrative as it should be understood that drive assembly 12 may be mounted alone on sliding platform 30 while pump 18 is immovably disposed at a discrete location while still being arranged in driving relationship with gear 14 through the appropriate intermediate linkages and/or drive train connections.

Figure 3:
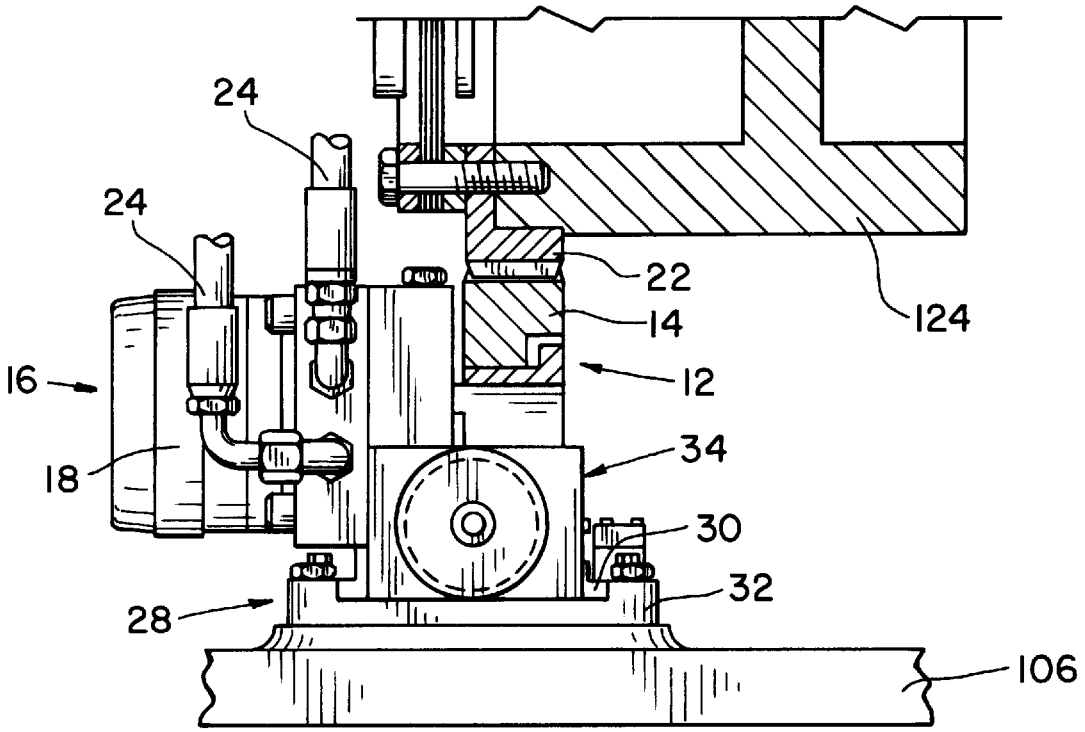
FIG. 3 is a lateral elevational schematic view of the present invention as shown in FIG. 2 illustrating the manner and form of engagement between the drive system and flywheel.

Slider mount 32, in one illustrative form thereof shown more clearly in FIG. 3, has side areas that extend vertically upward and inward to define a recess area therebetween that serves to slidedly secure sliding platform 30 disposed therein. Sliding platform 30, for example, has horizontally extending side areas that abut the inner surfaces of the side areas of slider mount 32 in a manner that accommodates relative sliding therebetween. Slider mount 32, in particular, confines the movement of sliding platform 30 in such a manner that it prevents vertical or rotational movement of sliding platform 30 while permitting a sliding-type reversibly linear motion. Slider mount assembly 28, in general, is configured with a view towards enabling drive assembly 12 affixed to sliding platform 30 to be brought into controllable engagement with flywheel 124 in the manner described herein.

Adjustment assembly 20 further includes a hydraulic motion actuator 34 preferably provided in the form of a piston-cylinder device comprising a spring-assisted, reversibly displaceable piston element 36 disposed within a cylinder element 38. Actuator 34 is preferably mounted to slider mount 32. As shown, the shaft body of piston 36 is attached at its exteriorly-disposed end to a coupling device 40 to establish a physical connection between actuator 34 and sliding platform 30. This shaft portion of piston 36 acts as a push rod to facilitate the reversible displacement of sliding platform 30 and hence the selective engagement of gear 14 with flywheel 124. Coupling device 40 may be provided in the form of a block secured to sliding platform 30 or any other suitable means enabling the rectilinear piston activity of actuator 34 to be transmitted to gear 14 through movement of sliding platform 30. Piston 36, at a head portion thereof, is attached to a compressible spring element 50 having one end fixedly secured to cylinder 38 at an inner surface thereof. Piston 36 defines with integral cylinder 38, in one form thereof, a pair of first and second fluid control chambers 42 and 44, respectively, that facilitate the reversibly movable action of piston 36. For this purpose, hydraulic actuator 34 is provided with fluid lines 46 disposed in fluid communication with fluid control chambers 42, 44 and further provided with a fluid control device 48 disposed in one of the fluid lines 46 for controlling the hydraulic condition of actuator 34. Actuator 34 operates in a conventional manner to cause a reversible displacement of piston 36 in response to pressurization changes that occur in fluid control chambers 42, 44 under the direction and control of fluid control device 48. Fluid control device 48, among other alternative forms, may include a two-position solenoid valve, manual or computer controlled valves, pumps, manifolds, or other such mechanisms for controlling and supplying hydraulic fluid. Hydraulic motion actuator 34 is shown for illustrative purposes only as it should be understood that adjustment assembly 20 may incorporate other mechanisms (e.g., hydraulic, electrical, mechanical) capable of effecting a reversible displacement of sliding platform 30 and hence drive assembly 12.

Figure 2:
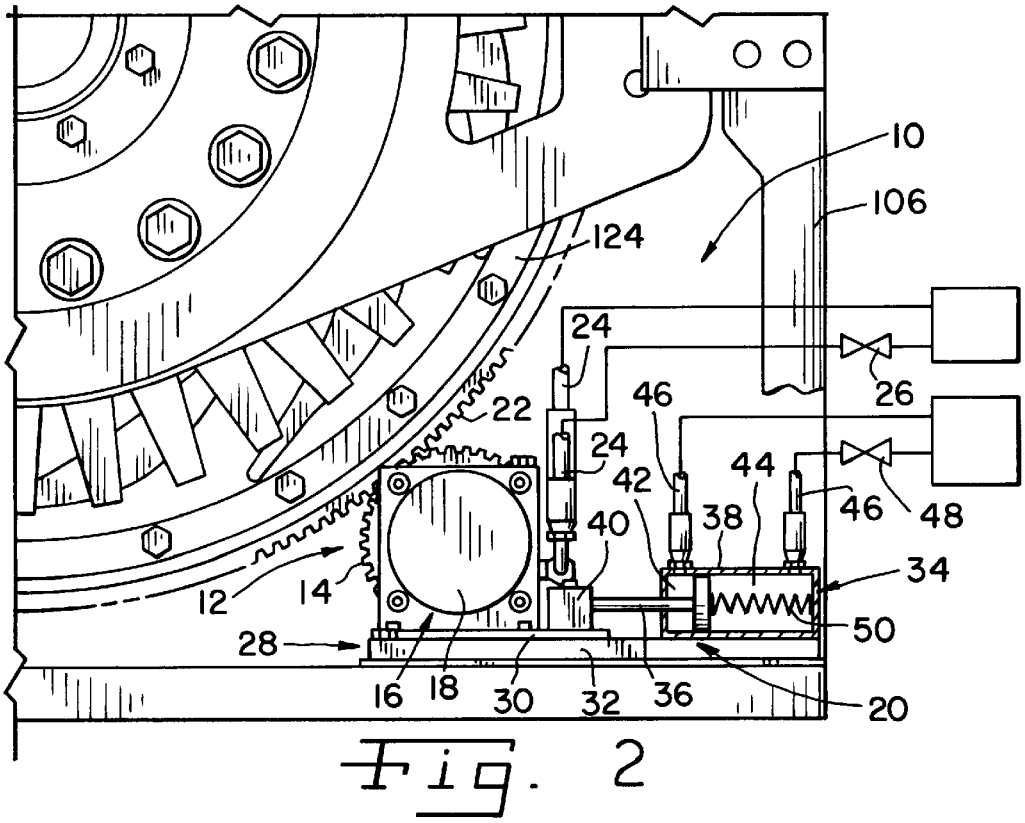
FIG. 2 is an elevational schematic view of the present invention in one illustrative form thereof depicting the drive system as engaged to the flywheel.

Referring now to FIG. 2 for an understanding of the operation of the present invention, there is illustratively shown a condition of engagement in which pinion gear 14 at its toothed periphery is arranged in intermeshing engagement with flywheel 124 at its toothed periphery 22. To activate this condition, fluid control device 48 of actuator 34 is suitably programmed to cause a controllable displacement of piston 36 that in turn acts through coupling device 40 to move gear 14 into engaging contact with flywheel 124 in the manner shown. Fluid control device 48, for example, may cause fluid to be simultaneously introduced into control chamber 44 and removed from control chamber 42 such that, with the assistance of spring 50, this type of hydraulic fluid regulation will displace piston 36 in a manner facilitating the indicated engagement of gear 14 with flywheel 124.

At this moment of engagement, flywheel 124 exerts a driving influence on gear 14 that transfers rotational energy from flywheel 124 into a rotational motion of gear 14. Hydraulic pump 18 now becomes operational due to its driving connection with the flywheel-driven gear 14, thereby generating a flow of hydraulic fluid in one of its fluid lines 24 that is preferably provided to the press machine for purposes of lubrication and heat dissipation. If a condition of disengagement is desired, fluid control device 48 suitably programs the hydraulic condition of hydraulic actuator 34 to effect a reversing displacement of drive assembly 12 that separates gear 14 from flywheel 124. The preferred form of the present invention arranges pinion gear 14 for selective engagement with flywheel 124. However, another form may configure gear 14 in a state of permanent engagement with flywheel 124, making adjustment assembly 20 an unnecessary part of drive system 10.

The illustrated drive system 10 according to the present invention has several beneficial features. The engagement of drive assembly 12 to flywheel 124 effectively configures flywheel 124 as a source of motive power in which its rotational energy is communicated to pinion gear 14, which itself is then driven into rotation as a result of the contacting engagement. This allows a discrete device such as hydraulic pump 18 to be operated on the basis of the acquired flywheel energy by simply arranging pump 18 in driving relationship with gear 14. Configured in this manner, pump 18 may serve as an auxiliary or supplemental unit for independently delivering pressurized fluid to the press machine concurrent with the primary lubrication system. Alternatively, pump 18 may be provided as part of a back-up lubrication arrangement that becomes operative in the event that the normally powered lubrication system becomes inactive due to a loss in supplied electricity. A loss in electrical power to the press machine will not cause the flywheel to be immediately halted in light of its inertial characteristics. Accordingly, since pump 18 runs off energy from the inertial-performing flywheel 124, hydraulic fluid can still be provided to the press machine during power failures by ensuring that gear 14 becomes engaged to flywheel 124 to thereby activate pump 18. For this purpose, fluid control device 48 would be provided with a suitable control mechanism and/or arranged for communication with a press controller to enable detection of a power failure condition in order to signal that the engagement procedure should be triggered. Of course it should be understood that gear 14 may be controlled to engage flywheel 124 at any other desired time or circumstance.

In another form of the present invention, the engagement of drive assembly 12 with flywheel 124 could be used to generate a type of rotational resistance that opposes the flywheel motion in a manner characteristic of a braking effect which acts to retard the flywheel motion and slow it down and/or stop it. This type of braking arrangement, for example, would configure gear 14 such that its ease (or difficulty) of rotation was tailored to meet the braking requirements for the flywheel and hence the interconnected slide. For example, a drive assembly 12 that supports a rapid braking capability would design and/or arrange gear 14 so that it required a high level of torque (i.e., energy from the flywheel) to initiate and sustain rotation. This feature could be met by connecting drive assembly 12 to a load assembly 16 that draws sufficient power compatible with a high-torque operation.

The braking resistance utilized in one form, comes from the inevitable frictional losses of pumping the oil through passages (hose/pip/etc.) to reach the lubrication points. The braking resistance in another form may come from an adjustable valve or orifice that could increase or decrease the (pressure) losses and thus the resistance slowing the rotary member. Pump 18 could supply fluid not only to lubrication points but also to an accumulator (not shown) that could hold fluid and pressure until after the rotary member had stopped, then discharging it to prolong the lubrication and temperature dissipation effects of the lubrication system.

The present invention, in general, involves a method and system for extracting energy from a rotary member and, in a preferred form, utilizing the extracted energy to power other devices. Its preferred implementation relates to a press machine application in which the illustrated drive assembly 12 is provided in the form of gear 14 for engagement with a rotary member provided in the form of flywheel 124 such that gear 14 is rotatably driven by flywheel 124. The type of engagement associated with this preferred arrangement involves an intermeshing contact between gear 14 and flywheel 124 at respective toothed peripheral surfaces thereof. An adjustment assembly 20 is provided, in part, in the form of a hydraulic actuator 34 utilizing a piston-cylinder arrangement to facilitate the controllably reversible displacement of gear 14 to effect its selective engagement with the flywheel. A load assembly 16 provided in the form of a hydraulic pump 18 utilizes the rotary power acquired by gear 14 from flywheel 124 for the purposes of developing a hydraulic fluid flow supplied to the press machine. It should be understood that the individual assemblies shown and described herein should not be considered in limitation of the present invention but as representing illustrative forms thereof.

In this regard, drive assembly 12 is generally representative of any means by which rotational (i.e., kinetic) energy can be withdrawn from a rotary member through a process of engagement therewith. The extracted energy is preferably made available in a suitable form (e.g., rotational motion) for use by a connected device (e.g., pump). According to the illustrated form of the present invention, this rotary member preferably corresponds to flywheel 124, while the form of interaction for implementing the energy extraction is developed by an intermeshing engagement involving the geared periphery of pinion gear 14 and the geared circumference 22 of flywheel 124. Other forms of engagement are encompassed by the present invention, such as a frictional coupling that utilizes selectively movable planar-type plates that frictionally contact the facial surfaces of flywheel 124.

Additionally, load assembly 16 is generally representative of any means which acts as a delivery point for receiving and preferably utilizing the energy (or some derivative form thereof) extracted from the rotary member by drive assembly 12. Load assembly 16, in one form thereof, may be considered as representing any facility to which is delivered power in the form of rotational energy. According to the illustrated form of the present invention, load assembly 16 includes hydraulic pump 18 arranged in driving relationship with gear 14 of drive assembly 12. Alternatively, load assembly 16 may include, in combination with pump 18, a motor of conventional design, for example one of the hydraulic type such as a Model RE-18-07-04 hydraulic motor available from White Hydraulics Inc. In such a pump-motor combination, gear 14 would energize the hydraulic pump, which in turn would hydraulically activate the hydraulic motor to enable it to drive any attached devices. As a further alternative, load assembly 16 may include a generator device having a mechanical portion that is integrally coupled to gear 14 such that the rotational energy transmitted from gear 14 is transformed by the generator device into a corresponding electrical signal for powering any attached electrical devices.

Moreover, adjustment assembly 20 is generally representative of any means by which drive assembly 12 can be controllably reversibly maneuvered to accomplish the engagement of drive assembly 12 (i.e., gear 14) with the designated rotary member (i.e., flywheel 124) in the manner of the present invention in order to facilitate the transfer of energy from flywheel 124 to gear 14. According to the illustrated form of the present invention, adjustment assembly 20 effects such controllable displacement based upon hydraulic actuating principles embodied in the form of hydraulic motion actuator 34. However, adjustment assembly 20 may include other such actuators producing a similar type of motion activity, such as equipment based upon purely mechanical or electro-mechanical operating principles. Adjustment assembly 20 may likewise operate to displace load assembly 16 (or a portion thereof) if load assembly 16 is integrally arranged with drive assembly 12, such as the case herein in which gear 14 and pump 18 are provided in modular combination both subject to the displacing action of hydraulic motion actuator 34.

It would be possible to operate the present invention in reverse, that is, add energy to flywheel 124 by engaging drive assembly 12 to flywheel 124 and controllably adding energy by applying hydraulic pressure via a source of pressurized hydraulic fluid to pump 18. In this embodiment, the drive system 10 would operate to move or bar flywheel 124 for various press set up purposes. Pump 18 in this case would be constructed to operate both as a pump (to remove energy from flywheel 124) and as a motor (to add energy to flywheel 124).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for use in a press machine, said press machine including a frame structure with a crown and a bed, a slide operatively guided by the frame structure for reciprocating movement in opposed relation to said bed, and a press drive means attached to said frame structure for operatively reciprocating said slide, said press drive means including a rotary member, said system comprising:

engagement means for selectively engaging the rotary member of said press drive means to withdraw rotational energy therefrom; and maneuvering means, operatively coupled to said engagement means, for controllably reversibly displacing said engagement means to effect the selective engagement of said engagement means with the rotary member of said press drive means.

2. The system as recited in claim 1, further comprises:

a load means, operatively arranged in energy communicating relationship with said engagement means, for having delivered thereto rotational energy withdrawn from the rotary member of said press drive means by said engagement means.

3. The system as recited in claim 2, wherein said load means further comprises:

a hydraulic pump arranged in driving relationship with said engagement means.

4. The system as recited in claim 3, wherein said hydraulic pump is arranged to provide a hydraulic fluid flow to said press machine.

5. The system as recited in claim 3, wherein said load means further comprises:

a motor arranged with said hydraulic pump.

6. The system as recited in claim 1, wherein said engagement means further comprises:

a rotary device including a geared surface and adjustably disposed for engagement at the geared surface thereof with the rotary member of said press drive means.

7. The system as recited in claim 6, wherein the rotary member of said press drive means includes a flywheel having a geared surface, and the rotary device of said engagement means includes a pinion gear for engagement with said flywheel at the geared surface thereof.

8. The system as recited in claim 7, further comprises:

a hydraulic pump arranged in driving relationship with said pinion gear.

9. The system as recited in claim 1, wherein said maneuvering means further comprises:

a slider mount assembly slidably securing said engagement means to said press machine;

a driving mechanism, operatively connected to said slider mount assembly, to effect a controllable reversible displacement of said engagement means; and a control means for controlling the operation of said driving mechanism.

10. The system as recited in claim 1, wherein said engagement means further comprises:

a plurality of rotary devices each having a geared peripheral surface and each arranged for operative engagement at the respective geared peripheral surface thereof with the rotary member of said press drive means.

11. The system as recited in claim 10, further comprises:

a plurality of hydraulic pumps each arranged in driving relationship with a respective one of said plurality of rotary devices.

12. The system as recited in claim 11, wherein said maneuvering means further comprises:

an adjustment assembly arranged to controllably displace each one of said plurality of rotary devices into a respective selectable one of engagement with said rotary member and disengagement from said rotary member.

13. The system of claim 1 in which said engagement means is able to selectively add or withdraw rotational energy to the rotary member.

14. A system for use in a press machine, said press machine including a frame structure with a crown and a bed, a slide operatively guided by the frame structure for reciprocating movement in opposed relation to said bed, and a press drive means attached to said frame structure for operatively reciprocating said slide, said press drive means including a rotary member, said system comprising:

a drive assembly arranged for operative engagement with the rotary member of said press drive means to enable said rotary member to exert a driving influence on said drive assembly; and a load system, including a mechanical assembly, arranged to be driven, at least in part, by said drive assembly.

15. The system as recited in claim 14, further comprises:

an adjustment assembly arranged to controllably reversibly dispose said drive assembly into a selectable one of engagement with said rotary member and disengagement from said rotary member.

16. The system as recited in claim 15, wherein said adjustment assembly further comprises:

a slider mount assembly slidably securing said drive assembly to said press machine;

a driving mechanism, operatively connected to said slider mount assembly, to effect a controllable reversible displacement of said drive assembly; and a control means for controlling the operation of said driving mechanism.

17. The system as recited in claim 16, wherein the driving mechanism of said adjustment assembly further comprises:

a hydraulic piston-cylinder device.

18. The system as recited in claim 14, wherein said drive assembly further comprises:

a gear including a geared surface and arranged for operative driving rotation by said rotary member by selective engagement at the geared surface thereof with said rotary member.

19. The system as recited in claim 18, wherein the mechanical assembly of said load system further comprises:

a hydraulic pump arranged in driving relationship with the gear of said drive assembly.

20. The system as recited in claim 19, further comprises:

an adjustment assembly arranged to controllably reversibly displace the gear of said drive assembly into selective engagement with said rotary member.

21. The system as recited in claim 18 in which said pump may be operated in reverse to drive said rotary member.

22. A system for use in a press machine, said press machine including a press rotary member rotatably mounted therein, said system comprising:

a rotary device selectively engaging said press rotary member to enable operative driving rotation of said rotary device by said press rotary member;

a first assembly, including a movable element, arranged in operative driving relationship with said rotary device; and a displacing assembly arranged to controllably reversibly dispose said rotary device to cause the selective engagement of said rotary device with said press rotary member.

23. The system as recited in claim 22, wherein said press rotary member further includes a flywheel having a geared periphery, and said rotary device further includes a gear having a geared surface for intermeshing engagement with the geared periphery of said flywheel.

24. The system as recited in claim 23, wherein said first assembly further includes:

a pump including a rotary element and arranged in operative driving relationship with the gear of said rotary device.

25. The system as recited in claim 22, wherein said displacing assembly further comprises:

a slider mount assembly slidably securing said rotary device to said press machine;

a driving mechanism, operatively connected to said slider mount assembly, to effect a controllable reversible displacement of said rotary device; and a control means for controlling the operation of said driving mechanism.

26. A system for use in a press machine, said press machine including a flywheel rotatably mounted therein, said system comprising:

a rotary device operatively engaging said flywheel to enable operative driving rotation of said rotary device by said flywheel, said rotary device including a geared peripheral surface for operative intermeshing engagement with said flywheel at a geared peripheral surface thereof; and a first assembly, including a pump, arranged in operative driving relationship with said rotary device.

27. The system as recited in claim 26, further comprises:

a displacing assembly arranged to controllably reversibly displace said rotary device into a selectable one of engagement with said flywheel and disengagement from said flywheel.

28. The system as recited in claim 27, wherein said displacing assembly further comprises:

a slider mount assembly slidably securing said rotary device to said press machine;

a driving mechanism, operatively connected to said slider mount assembly, to effect a controllable reversible displacement of said rotary device; and a control means for controlling the operation of said driving mechanism.

29. The system as recited in claim 26, wherein the pump of said first assembly is arranged to provide a hydraulic fluid flow for use in said press machine.

30. The system as recited in claim 26, wherein said rotary device is permanently engaged to said flywheel.

31. A mechanical press, comprising:

a frame structure with a crown and a bed;

a slide operatively guided by the frame structure for reciprocating movement in opposed relation to said bed;

a press drive means attached to said frame structure for operatively reciprocating said slide, said press drive means comprising a flywheel having a geared peripheral surface;

a drive assembly selectively engaging said flywheel to enable operative driving rotation of said drive assembly by said flywheel, said drive assembly including at least one gear having a geared peripheral surface for selective engagement with said flywheel;

a first assembly arranged in operative driving relationship with said drive assembly, said first assembly including at least one pump each arranged in operative driving relationship with a respective one of the at least one gear of said drive assembly; and a displacing assembly arranged to controllably reversibly dispose each one of the at least one gear of said drive assembly to cause the selective engagement of said drive assembly with said flywheel, said displacing assembly comprising:

a slider mount assembly slidably securing said drive assembly to said mechanical press;

a driving mechanism, operatively connected to said slider mount assembly, to effect a controllable reversible displacement of said drive assembly; and a control means for controlling the operation of said driving mechanism.

32. A method of selectably extracting rotational energy from a press rotary member rotatably mounted in a press machine, said method comprising the steps of:

selectable engaging said press rotary member at the outer periphery thereof with a rotary device to enable operative driving rotation of said rotary device by said press rotary member; and providing a load assembly arranged in operative driving relationship with said rotary device.

33. The method as recited in claim 32, wherein said load assembly further includes a hydraulic pump.

34. The method as recited in claim 32, wherein said engaging step further comprises the step of:

controllably reversibly displacing said rotary device to effect a selective engagement of said rotary device with said press rotary member.

35. The method as recited in claim 34, wherein said press rotary member includes a flywheel having a geared periphery, and said rotary device includes a gear having a geared periphery for intermeshing engagement with said flywheel at the geared periphery thereof.

36. A method of supplying a press machine with a hydraulic fluid flow, said press machine including a press rotary member rotatably mounted therein, said method comprising the steps of:

engaging said press rotary member at the outer periphery thereof with a rotary device to enable operative driving rotation of said rotary device by said press rotary member; and providing a hydraulic pump arranged in operative driving relationship with said rotary device and further arranged in operative fluid flow communication with said press machine.

37. The method as recited in claim 36, wherein said engaging step further comprises the step of:

controllably reversibly displacing said rotary device to effect a selective engagement of said rotary device with said press rotary member.

38. The method as recited in claim 37, wherein said press rotary member includes a flywheel having a geared periphery, and said rotary device includes a gear having a geared periphery for intermeshing engagement with said flywheel at the geared periphery thereof.

* * * * *